US007471916B2

(12) United States Patent
Sanada et al.

(10) Patent No.: US 7,471,916 B2
(45) Date of Patent: Dec. 30, 2008

(54) DEVELOPER STORING CONTAINER AND CONNECTING MEMBER

(75) Inventors: Yoshiaki Sanada, Ikoma (JP); Hisashi Kunihiro, Nara (JP); Koichi Mihara, Fujiidera (JP)

(73) Assignee: Sharp Kabushiki Kaisha, Osaka (JP)

( * ) Notice: Subject to any disclaimer, the term of this patent is extended or adjusted under 35 U.S.C. 154(b) by 279 days.

(21) Appl. No.: 11/233,020

(22) Filed: Sep. 23, 2005

(65) Prior Publication Data

US 2006/0067735 A1 Mar. 30, 2006

(30) Foreign Application Priority Data

Sep. 30, 2004 (JP) ..... 2004-288487

(51) Int. Cl.
*G03G 15/08* (2006.01)

(52) U.S. Cl. ..... 399/120; 399/254; 399/263; 399/360

(58) Field of Classification Search ..... 399/120, 399/254, 263, 358, 360
See application file for complete search history.

(56) References Cited

U.S. PATENT DOCUMENTS 7,272,346 B2 * 9/2007 Ito ..... 399/263

FOREIGN PATENT DOCUMENTS

| | | |
|---|---|---|
| JP | 7-199617 | 8/1995 |
| JP | 9-258541 | 10/1997 |
| JP | 10-97131 | 4/1998 |
| JP | 2001-109244 | 4/2001 |
| JP | 2001-356577 | 12/2001 |
| JP | 2003-98815 | 4/2003 |
| JP | 2003-337465 | 11/2003 |

* cited by examiner

*Primary Examiner*—David M Gray
*Assistant Examiner*—Ruth N Labombard
(74) *Attorney, Agent, or Firm*—Nixon & Vanderhye, P.C.

(57) ABSTRACT

In a developer-storing container of the present invention, an agitation blade used in a toner-storing section and an agitation blade used in a waste-toner-storing section are coupled by a rotor. The rotor is interdigitated to a bearing mounted on a partition wall. The partition wall is made to be a fixed wall so that precision of interdigitation of the agitation blade of the toner-storing section, the rotor, and the agitation blade of the waste-toner-storing section is improved. Consequently, a developer-storing container that is easy to assemble and in which precision of interdigitation is high is realized.

18 Claims, 5 Drawing Sheets

DEVELOPER STORING CONTAINER AND CONNECTING MEMBER

This Nonprovisional application claims priority under 35 U.S.C. § 119(a) on patent application Ser. No. 288487/2004 filed in Japan on Sep. 30, 2004, the entire contents of which are hereby incorporated by reference.

TECHNICAL FIELD

The present invention relates to a developer-storing container storing and agitating developer that is to be supplied to a developing tank of an image forming apparatus.

BACKGROUND

Many image forming apparatuses such as copying machines include a developer-storing container that supplies a developing tank with developer. Japanese Unexamined Patent Publication No. 2001-356577 (published on Dec. 26, 2001) discloses a particle-storing container in which an agitation member is taken in/out from a large aperture section disposed at the top of the inner part of the container, the agitation member is easy to mount on the main body of the container, and the agitation member is easy to take out from the container for re-use.

Japanese Unexamined Patent Publication No. 2003-337465 (published on Nov. 28, 2003) discloses a toner cartridge that is detachably mounted on an image forming apparatus. In the toner cartridge, an agitation member for agitating toner which fills the toner cartridge is slidably mounted in an axial direction. Upon insertion into the image forming apparatus, the agitation member contacts a pressing member disposed on the side close to the image forming apparatus so as to be slidden to an in-use position that is different from a not-in-use position.

Japanese Unexamined Patent Publication No. 2001-109244 (published on Apr. 20, 2001) discloses a development apparatus in which an agitation section is composed of connection sections that connects adjoining agitation members, the agitation members divided into a plurality of members along the axial direction having the same shape, and a restraint section disposed in a development container to restrain the connection section. The development apparatus rotates, upon receiving drive, to supply a development roller with developer in the development container.

FIG. 5 shows a cross section that illustrates a physical relationship between a toner cartridge 101 that is a conventional developer-storing container included in a copying-machine and a developing tank 102.

The toner cartridge 101 contains toner that has developer inside, and the toner is agitated by an agitation blade 101*a*. The toner cartridge 101 supplies the developing tank 102 with the toner through a supply opening 102*a* by using a supply roller 101*b*. In the developing tank 102, the supplied toner is agitated by an agitation roller 102*b* and is sent to an agitation roller 102*c*. The agitation roller 102*c* agitates the supplied toner and sends it to a development roller 102*d*. A doctor blade 102*e* is mounted above the development roller 102*d* and controls the thickness of the layer of toner on the development roller 102*d*. This allows the development roller 102*d* to supply a photoconductor 103 with a certain amount of toner. Further, a toner sensor 102*f* is mounted below the agitation roller 102*c* in the developing tank 102. The toner sensor 102*f* detects a residual amount of toner in the developing tank 102.

FIG. 6 shows a cross section of the toner cartridge 101 along a shaft of the photoconductor 103. The toner cartridge

101 includes a toner-storing section 111 and a waste-toner-storing section 112. A core cylinder 101*d* partitions space in the toner cartridge 101 such that the toner-storing section 111 and the waste-toner-storing section 112 are adjacent to each other in the direction the shaft extends (axial direction). The toner-storing section 111 is a section that stores toner to be supplied to the developing tank 102. The toner-storing section 111 includes the agitation blade 101*a*. The waste-toner-storing section 112 is a section that stores residual toner that was not transferred to an image in an image-forming process and was retrieved. The waste-toner-storing section 112 includes an agitation blade 101*c*.

In order to assemble the agitation blade 101*a* and the agitation blade 101*c* in the housing, the core cylinder 101*d* is detachably mounted in the housing of the toner cartridge 101. The agitation blade 101*a*, the agitation blade 101*c*, and the core cylinder 101*d* are constructable and deconstructable in the housing. A bearing 101*e* is mounted on an end section of housing of the toner cartridge 101 that is on the side close to the toner-storing section 111. A bearing 101*f* is mounted on the core cylinder 101*d*. A bearing 101*g* is mounted on an end section of housing of the toner cartridge 101 that is on the side close to the waste-toner-storing section 112. The agitation blade 101*a* includes a flange 101*h* on an axial end section on the side close to the bearing 101*e*. The flange 101*h* is connected by the bearing 101*e* to the driving shaft system 113 that transmits driving force from the outside of the toner cartridge 101. The driving shaft system 113 includes a clutch and a gear that transmit driving force from a motor. A sponge 101*j* acting as a sealing member is mounted in between the flange 101*h* and the housing. Further, the agitation blade 101*a* includes a flange 101*i* on an axial end section on the side close to the bearing 101*f*. The flange 101*i* is connected by the bearing 101*f* to an axial end section of the agitation blade 101*c* that is on the side close to the bearing 101*f*. A sponge 101*k* acting as a sealing member is mounted in between the flange 101*i* and the core cylinder 101*d*. An axial end section of the agitation blade 101*c* that is on the side close to the bearing 101*g* is supported by the bearing 101*g*. This allows an axle of the agitation blade 101*a* and an axle of the agitation blade 101*c* to be connected to each other in such a way that the axles form one axle.

However, in the conventional structure of the toner cartridge 101 described above, the agitation blade 101*a*, the agitation blade 101*c*, and the core cylinder 101*d* are constructable and deconstructable in the housing. Accordingly, in order to absorb dimensional distortion of the members due to assembly, each member is designed in such a way that some deviation is allowed in its dimensions so as to be easily assembled. Therefore, the members are loosely interdigitated with each other. Consequently, problems may arise in which sufficient driving force for rotating the agitation blades 101*a* and 101*c* is not transmitted to the toner cartridge 101, or in which toner leaks and solidifies in a gap between the bearings 101*e*, 101*f*, and 101*g* and the axle.

SUMMARY

Example embodiments of the present invention are in view of the conventional problems described above and has as an object to realize a developer-storing container that is easy to assemble and in which assembly dimensions of members are precise enough for the members to be closely interdigitated to each other.

A developer-storing container includes a developer-storing section including a developer agitation member that rotates to agitate developer, and a waste-developer-storing section including a waste-developer agitation member that rotates to agitate waste-developer, an axle of the developer agitation member and an axle of the waste-developer agitation member being coupled so as to form one axle, and the developer-storing section and the waste-developer-storing section being formed so as to be adjacent to each other in a direction of the axle. In order to achieve the above object, a developer-storing container in connection with the above structure is characterized in that the developer-storing section and the waste-developer-storing section are formed by being partitioned by a fixed wall, fixed to a housing of the developer-storing container in such a way as to be adjacent to each other in the direction of the axle, and the developer agitation member and the waste-developer agitation member are constructably and deconstructably coupled to each other by a connecting member that is slidably, rotatably and detachably interdigitated to a bearing formed on the fixed wall.

Further, in order to achieve the above object, a developer-storing container in connection example embodiments is characterized in that the developer-storing container includes: a fixed wall, fixed to the developer-storing container and partitioning a developer-storing section that includes a developer agitation member that rotates to agitate developer, and a waste-developer-storing section that includes a waste-developer agitation member that rotates to agitate waste-developer; and a connecting member that is slidably, rotatably, and detachably interdigitated to the bearing formed on the fixed wall, the developer agitation member and the waste-developer agitation member being detachably interdigitated to the connecting member, respectively, and an axle of the developer agitation member, an axle of the connecting section, and an axle of the waste-developer agitation member forming one axle.

In the above structure, assembly is carried out by interdigitating a connecting member to a fixed wall so that the developer agitation member and the waste-developer agitation member are coupled. Using the fixed wall makes it easy to assemble the developer-storing container. Further, using a fixed wall makes it possible to assemble the connecting member in a precise position, and therefore the developer agitation member and the waste-developer agitation member are also assembled at precise positions.

Consequently, a developer-storing container that is easy to assemble and in which assembly dimensions of members are precise enough for the members to be closely interdigitated to each other is realized.

For a fuller understanding of the nature and advantages of the example embodiments, reference should be made to the ensuing detailed description taken in conjunction with the accompanying drawings.

DESCRIPTION OF THE EMBODIMENTS

The following describes an example embodiment, with reference to FIGS. 1 to 4.

Figure 1:
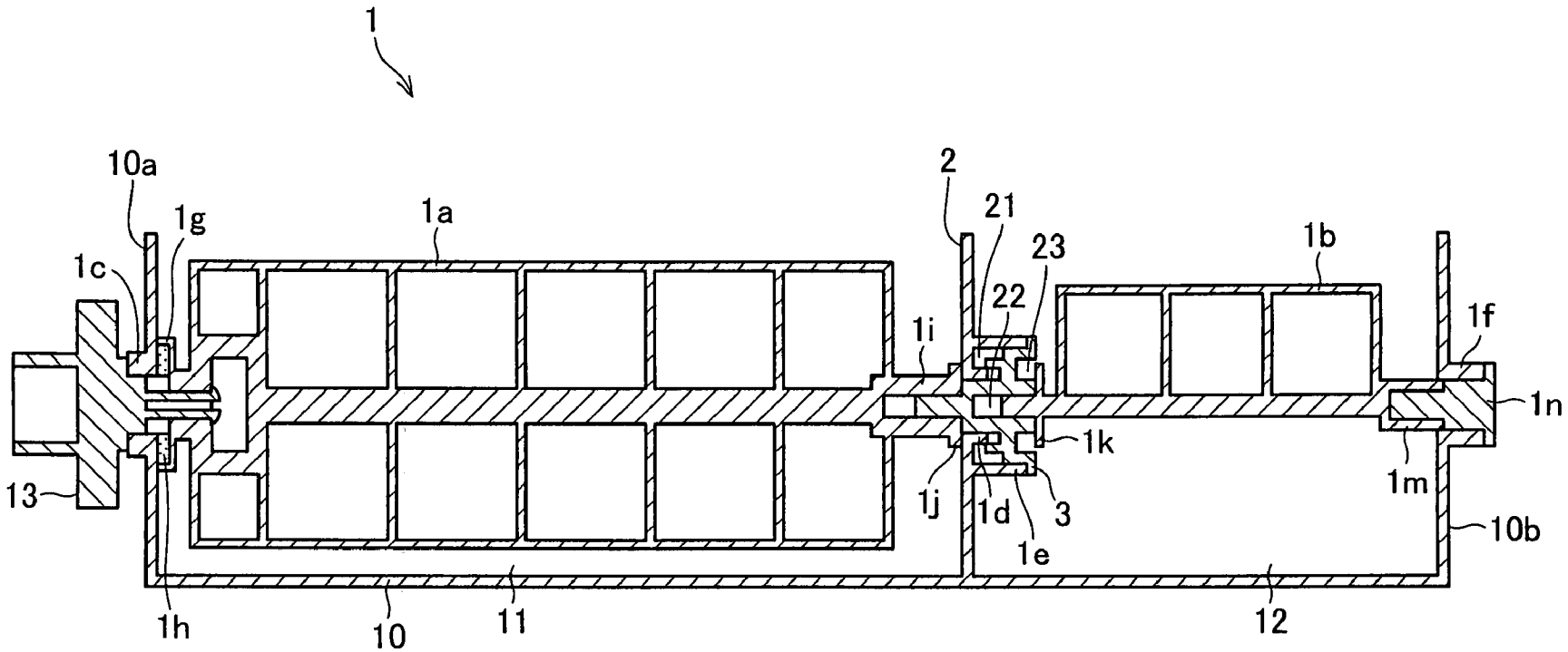
FIG. 1 illustrates an example embodiment. It is a cross section illustrating a structure of substantial part of a toner cartridge.

FIG. 1 illustrates a structure of a toner cartridge (developer-storing container) 1 in connection with the embodiment. This figure is a cross section along an axle of the photoconductor.

Figure 5:
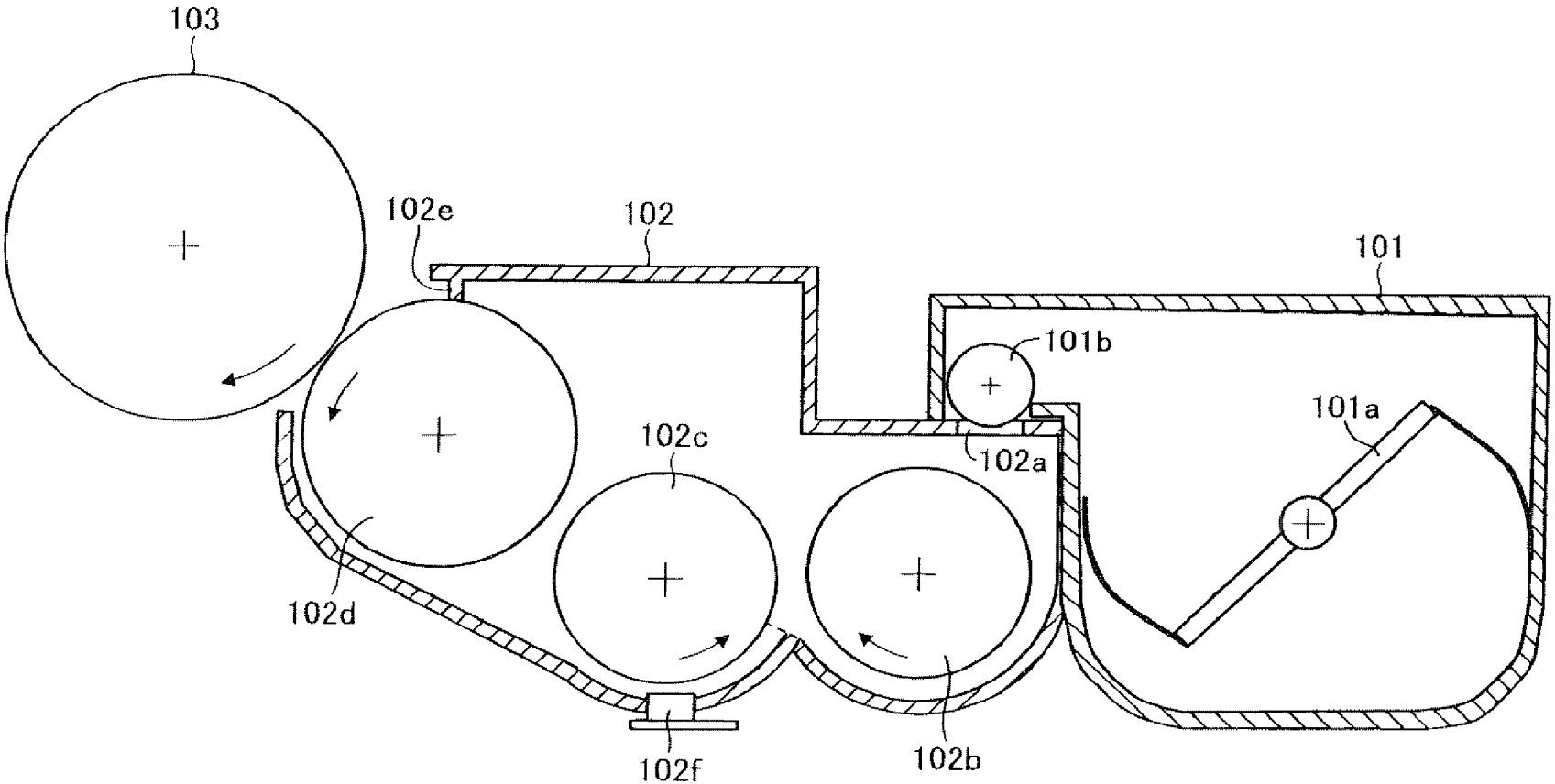
FIG. 5 (PRIOR ART)
FIG. 5 illustrates conventional art and is a cross section illustrating a structure around a developing unit of an image forming apparatus including a toner cartridge.
Figure 6:
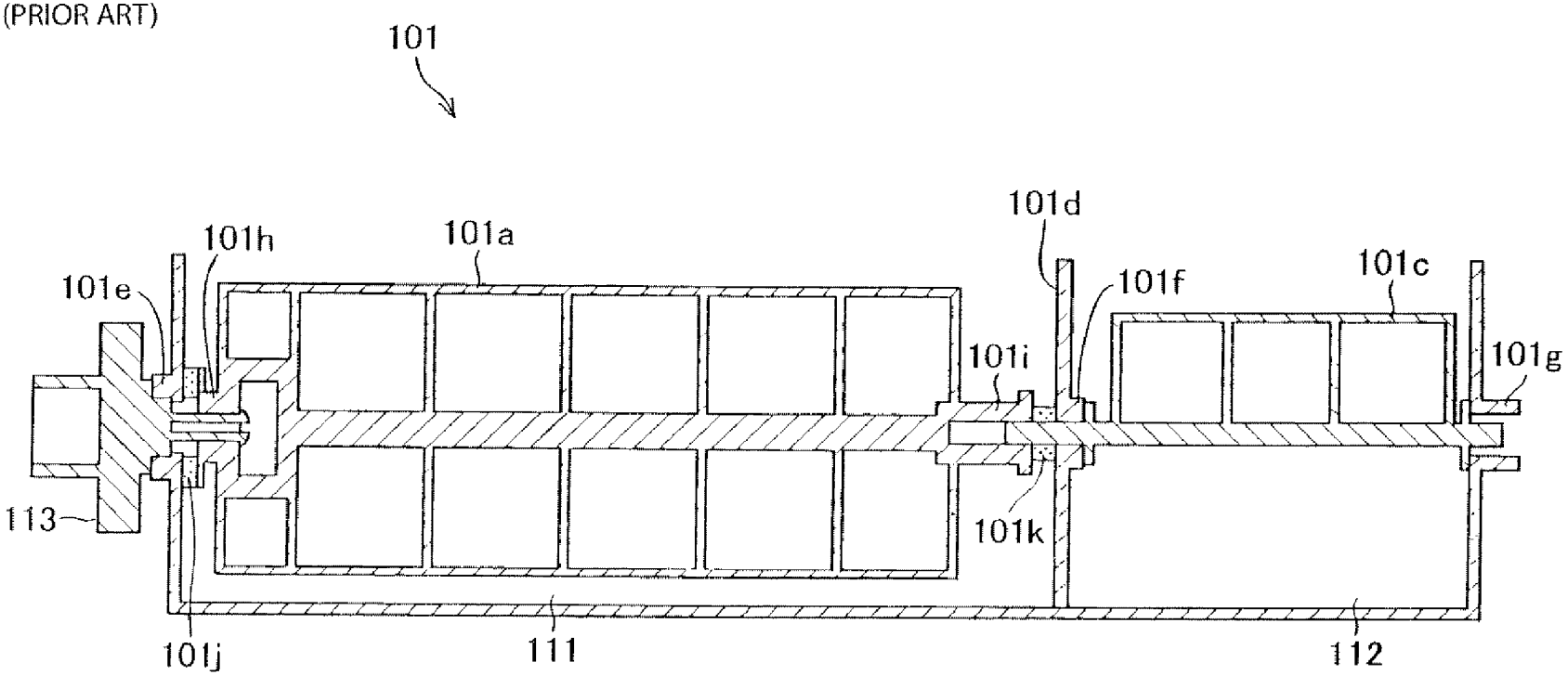
FIG. 6 (PRIOR ART)
FIG. 6 illustrates conventional art and is a cross section illustrating a structure of a substantial part of a toner cartridge.

The toner cartridge 1 includes a toner-storing section (developer-storing section) 11 and a waste-toner-storing section (waste-developer-storing section) 12. The toner-storing section 11 and the waste-toner-storing section 12 are formed with a partition wall (fixed wall) 2 partitioning the housing 10 of the toner cartridge 1. The toner-storing section 11 and the waste-toner-storing section 12 are adjacent to each other in the direction of the axle described below. The partition wall 2 forms a part of the housing 10 of the toner cartridge 1 and is fixed to the housing 10. The toner-storing section 11 includes an agitation blade (developer agitation member) 1*a*. The agitation blade 1*a* is formed of a flat, lattice-shaped frame having an axle in its core. The agitation blade 1*a* rotates about the axle to agitate toner (developer) that is to be supplied to a developing tank included in the toner-storing section 11. The waste-toner-storing section 12 includes an agitation blade (waste-developer agitation member) 1*b*. The agitation blade 1*b* is formed of a flat, lattice-shaped frame having an axle at one side. The agitation blade 1*b* rotates about the axle to agitate residual toner that was not transferred in an image forming process and was retrieved to the waste-toner-storing section 12. An agitation sheet that slides with respect to an inner wall of the housing may be mounted on end sections of the agitation blades 1*a* and 1*b* that are in the direction of the diameter of the rotation, similar to the agitation blade 101*a* of the toner cartridge 101 as illustrated in FIG. 5, described above. The axle of the agitation blade 1*a* and the axle of the agitation blade 1*b* are coupled to each other in such a way that the axles form one axle. The axles are parallel to the axle of the photoconductor.

A bearing 1*c* that extends outwardly from the housing 10 is formed on a wall 10*a* of the housing 10 that is opposite to the partition wall 2 with respect to the agitation blade 1*a*. Bearings 1*d* and 1*e*, which extend toward the waste-toner-storing section 12, are formed on the partition wall 2. An axle-hole section 1*f* is formed on a wall 10*b* of the housing 10 that is opposite to the partition wall 2 with respect to the agitation blade 1*b*.

The agitation blade 1*a* includes a flange 1*g* on an end section of the axle that is on the side closer to the wall 10*a*. The flange 1*g* is connected to a driving shaft system 13 that transmits driving force from outside of the toner cartridge 1 through the bearing 1*c*. The driving shaft system 13 includes a clutch and a gear that transmits driving force from a motor. A sealing member 1*h* that prevents leakage of toner to the outside of the housing is mounted in between the flange 1*g* and the wall 10*a*. Besides sponge, films, such as polyester films, may be used as the sealing member 1*h*. The agitation blade 1*a* includes, on an end section of the axle that is closest to the partition wall 2, a cylindrical-shaped flange 1*i* having an end section with an aperture. An axle of the rotor (connecting member) 3 is inserted partially into the cylindrical-shaped part of the flange 1*i* so that the agitation blade 1*a* is connected to the flange 1*i*. A sealing member 1*j* such as sponge or film that prevents migration of toner to the waste-toner-storing section 12 is mounted in between the flange 1*i* and the partition wall 2. The rotor 3 is interdigitated to the bearings 1*d* and 1*e* from the side close to the waste-toner-storing section 12. The rotor 3 is slidable and rotatable with respect to the bearings 1*d* and 1*e* and is detachable. An end section of the axle of the agitation blade 1*b* that is on the side close to the partition wall 2 of the agitation blade 1*b* is connected to the rotor 3 in such a way that the axle is partially interdigitated to the rotor 3. The agitation blade 1*b* includes a flange 1*k* on an end section of the axle that is close to the partition wall 2. The flange 1*k* is in contact with the closest end section of the rotor 3 to the wall 10*b*. The contact of the flange 1*k* makes it possible to sustain thrust load applied to the agitation blade 1*b* toward the partition wall 2. The agitation blade 1*b* further includes a flange 1*m* on an axle-end section on the end of the axle closest to wall 10*b*. The flange 1*m* is a cylindrical flange whose end section has an aperture. A press-fit member (axle-supporting member) 1*n* is inserted into an axle-hole of the axle-hole section 1*f* from the outside of the wall 10*b*. A part of press-fit member 1*n* that extends toward the inner part of the waste-toner-storing section 12 is inserted in the cylinder of the flange 1*m*. The press-fit member 1*n* is fixed to the wall 10*b*. The flange 1*m* slides and rotates about the press-fit member 1*n*.

In the manner described above, the agitation blade 1*a* and the agitation blade 1*b* are coupled by the rotor 3, and the axle of the agitation blade 1*a* and the axle of the agitation blade 1*b* form one axle.

As previously described, in the embodiment, the toner agitation blade 1*a* and the waste-toner agitation blade 1*b* are coupled by the rotor 3 in such a way as to be constructable and deconstructable. In this manner, the rotor 3 is interdigitated to the partition wall 2, which is a fixed wall, and the toner agitation blade 1*a* and the waste-toner agitation blade 1*b* are assembled by coupling, thereby easily assembling the toner cartridge 1 with the fixed wall. In addition, using a fixed wall makes it possible to assemble the rotor 3 at a precise position, thereby assembling the toner agitation blade 1*a* and the waste-toner agitation blade 1*b* at precise positions.

Accordingly, it is not necessary to design the members in a conventional way in which the dimensions of members include a wide margin for absorbing dimensional errors in assembly of the members. This eliminates looseness in interdigitation of assembled members. As a result, sufficient driving force for rotating the agitation blades 1*a* and 1*b* is transmitted to the toner cartridge 1, and it becomes difficult for toner to migrate to gaps between respective bearings and the axle. Therefore, a problem of solidification of toner in the gaps is less likely to occur.

The foregoing makes it possible to realize a developer-storing container that is easy to assemble and in which assembly dimensions of members are precise enough for the members to be closely interdigitated to each other.

Figure 2:
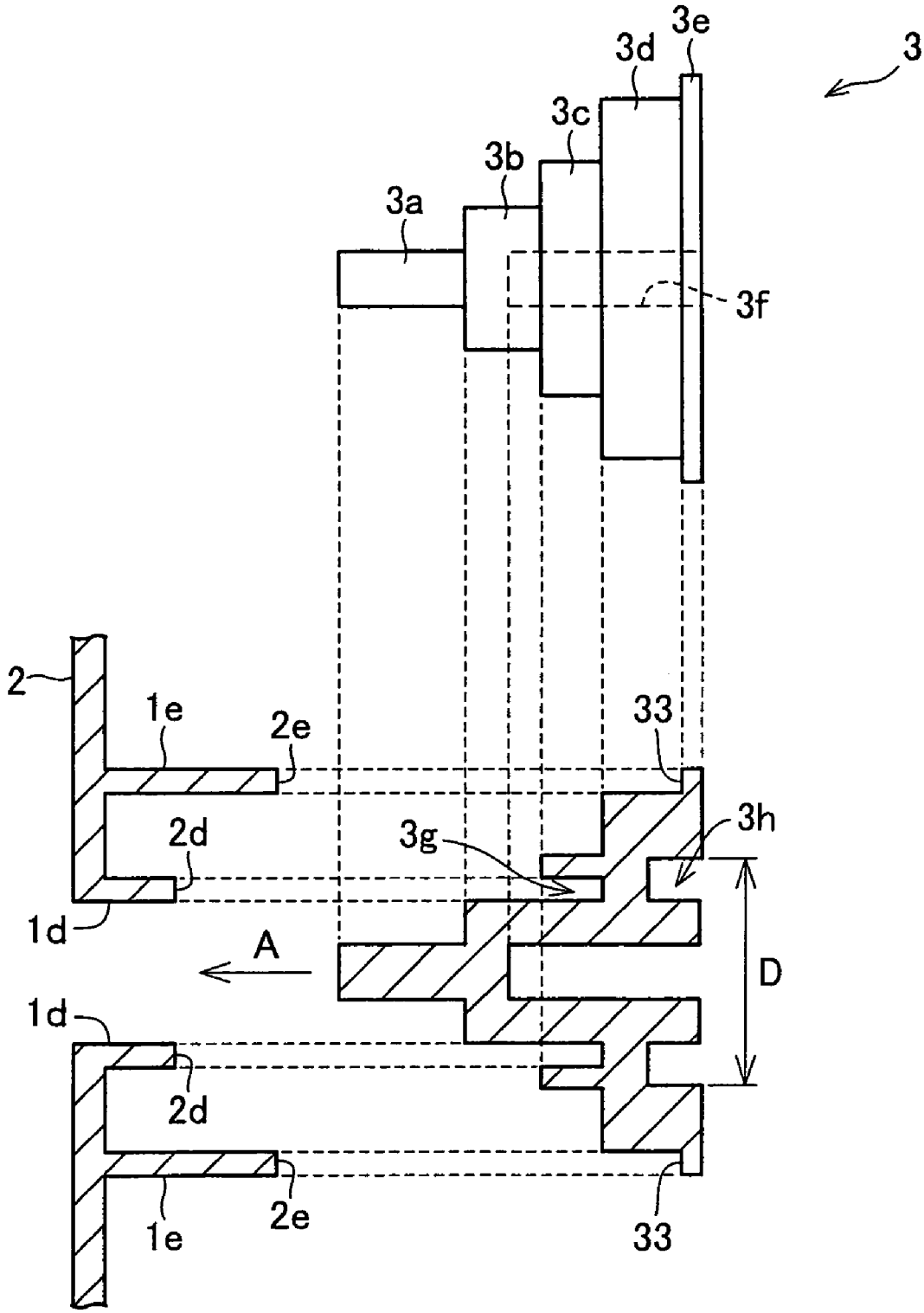
FIG. 2 is a figure illustrating in detail a structure of a rotor included in the toner cartridge in FIG. 1.

The following describes a structure of the rotor 3 of the toner cartridge 1 in the above structure, with reference to FIG. 2. The upper diagram in FIG. 2 is a side view of the rotor 3. The diagram below the side view is a cross section of the rotor 3 along the axle. The diagram on the left of the cross section is a cross section of the bearings 1*d* and 1*e*. The length of extension of the bearing 1*e* toward the waste-toner-storing section 12 is set to be longer than the length of extension of the bearing 1*d*.

As illustrated in the upper diagram in FIG. 2, the rotor 3 includes an axle 3*a*, a cylindrical section 3*b*, a cylindrical section 3*c*, a cylindrical section 3*d*, and a flange 3*e*, in the order as listed. Each of them is concentric on a cross section perpendicular with respect to the direction along the axle, and the respective radii increase in the order as listed above. An axle-hole 3*f* is formed in the rotor 3 from the flange 3*e* partway into the cylindrical section 3*b*. An axle of the agitation blade 1*b* is partially inserted into a part of the axle-hole 3*f*.

The axle 3*a* is a section extending toward the toner-storing section 11. As described above, the axle 3*a* is interdigitated to the flange 1*i* of the agitation blade 1*a*. The cylindrical section 3*b*, as illustrated in the diagram below the side view in FIG. 2, is a cylindrical section having the axle-hole 3*f* forming a hollow. An end section of the cylindrical section that is on the side near the partition wall 2 is closed. When the rotor 3 is interdigitated to the bearings 1*d* and 1*e*, the cylindrical side face of the cylindrical section 3*b* is supported by the bearing 1*d*. The inner face of the bearing 1*d* bears a radial load from the cylindrical section 3*b*. The cylindrical section 3*c* is a cylindrical section having a gap 3*g* created at an external position whose diameter is wider than the diameter of the cylindrical section 3*b* (referred to as "first external gap 3*g*", hereinafter), and having the axle-hole 3*f* forming a hollow. An end section of the first external gap 3*g* on the side close to the partition wall 2 has an aperture. When the rotor 3 is interdigitated to the bearings 1*d* and 1*e* in the direction of arrow A in the figure, the face 2*d* of the bearing id that faces towards the rotor 3, is positioned short of the first external gap. Therefore, the first external gap 3*g* remains as a hollow. The cylindrical section 3*d* is a cylindrical section having a gap 3*h* created at an external position whose diameter is wider than the inner diameter of the first external gap 3*g* of the cylindrical section 3*b* (referred to as "second external gap 3*h*", hereinafter), and the axle-hole 3*f* forms a hollow. An end section that is on the side close to the partition wall 2 is exposed outside and is closed. When the rotor 3 is interdigitated to the bearings 1*d* and 1*e*, the cylindrical side face of the cylindrical section 3*d* is supported by the bearing 1*e*, thereby the inner face of the bearing 1*e* bears radial load from the cylindrical section 3*d*. Further, an external diameter D of the second external gap 3*h* is set to be wider than the diameter of the flange 1*k* of the agitation blade 1*b*. The diameter of the axle-hole 3*f* is set to be smaller than the diameter of the flange 1*k*. The flange 3*e* is a flange having the second external place and the axle-hole 3*f* that are through-holes. When the rotor 3 is interdigitated to the bearings 1*d* and 1*e*, the face 33, which is created at an external position whose diameter is wider than the diameter of the cylindrical section 3*d* of the flange 3, is in contact with the plane 2*e* of the bearing 1*e* that faces towards the rotor 3, thereby the plane 2*e* bears a thrust load from the flange 3*e*.

Due to the above structure of the rotor 3 and the bearings 1*d* and 1*e*, a space 21 is formed between and surrounded by the partition wall 2 and the rotor 3, that is, between the bearing 1*d*, the bearing 1*e*, the partition wall 2 between the bearings 1*d* and 1*e*, and cylindrical sections 3*c* and 3*d* (see FIG. 1). The space 21 includes the external gap 3*g*. Further, a space 22 surrounded by an inner wall of the axle-hole 3*f* and the axle of the agitation blade 1*b* is formed (see FIG. 1). Further, a space 23 substantially surrounded by the cylindrical section 3*d*, the flange 3*e*, and the flange 1*k* of the agitation blade 1*b* is formed (see FIG. 1). The space 23 is identical to the second external gap 3*h*. The spaces 22 and 23 are spaces other than a space occupied by the axle and having an aperture on a side opposite to the side closest to the partition wall 2, and are created inside of the rotor 3, on a waste-toner-storing section 12 side.

The spaces 21 to 23 may be made to act as pools of toner. Even if toner migrates to the gap between the rotor 3 and the partition wall 2, the toner can be led to the space 21. In the space 21, mainly toner that has leaked from the toner-storing section 11 is pooled, thereby preventing solidification of toner in the gap between the rotor 3 and the partition wall 2. Further, even if toner migrates to the gap between the rotor 3 and the axle of the agitation blade 1*b*, the toner can be led to the spaces 22 and 23, thereby preventing solidification of toner in the gap between the rotor 3 and the axle of the agitation blade 1*b*.

In the embodiment, the rotor 3 is interdigitated to the bearings 1*d* and 1*e* of the partition wall 2 from the side close to the waste-toner-storing section 12, but the bearings 1*d* and 1*e* may be structured oppositely to FIG. 1 with respect to the partition wall 2 so that the rotor 3 is interdigitated to the bearings 1*d* and 1*e* of the partition wall 2 from the side close to the toner-storing section 11. In this case, the spaces 21 to 23 are formed on the side close to the toner-storing section 11.

Figure 3:
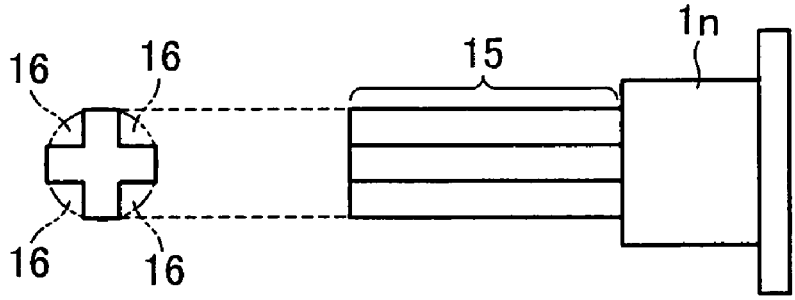
FIG. 3 is a figure illustrating in detail a structure of a press-fit member included in the toner cartridge in FIG. 1.

The following describes a structure of the press-fit member 1*n* of the toner cartridge 1 in the above structure, with reference to FIG. 3.

The diagram on the right in FIG. 3 is a side view of the press-fit member 1*n*. The diagram on the left in FIG. 3 is a diagram showing a top-end section on the press-fitting side (press-fit section 15 described below) of the press-fit member 1*n* in the direction opposite to the direction of press-fitting. The press-fit member 1*n* includes a press-fit section 15 that extends to the inner part of the waste-toner-storing section 12 while being interdigitated to the axle-hole section 1*f* from the outside of the wall 10*b*. The press-fit section 15 is a part that is to be inserted into the flange 1*m*. Grooves 16 . . . are axially formed on a surface of the press-fit section 15. In the figure, four grooves 16 . . . are formed in such a way that a section that is perpendicular to the axle of the press-fit section 15 forms a cross-shape. Forming such grooves 16 . . . allows the press-fit member 1*n* to be partially in contact with an inner face of the flange 1*m*. In this structure, a space is created between the inner face of the flange 1*m* and the press-fit member 1*n* acting as an axle-supporting member, thereby making the space act as a pool of toner. Therefore, even if toner migrates in between the inner face of the flange 1*m* and the press-fit member 1*n*, the toner can be led to the space, thereby preventing solidification of toner in a narrow gap. Any number of the grooves 16 . . . may be provided.

Figure 4:
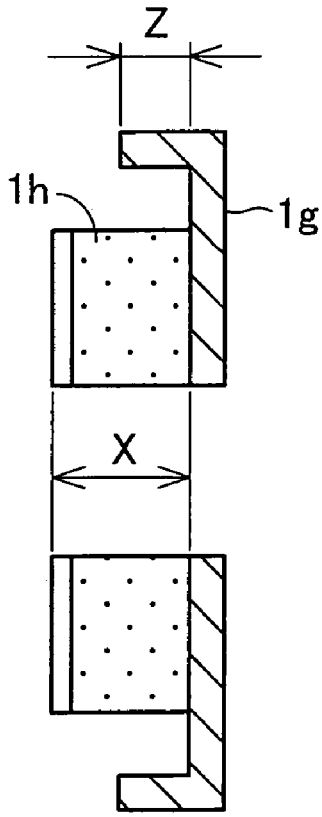
FIG. 4 is a figure illustrating in detail a structure of a crown-shaped flange and sealing member both of which are included in the toner cartridge in FIG. 1.

The following describes structures of the flange 1*g* and the sealing member 1*h* of the toner cartridge 1 in the above structure, with reference to FIG. 4.

FIG. 4 is a cross section along the axis of the flange 1*g* and the sealing member 1*h*. The flange 1*g* is crown-shaped having an external extension whose length is indicated as Z, on the side close to the wall 10*a*. The sealing member 1*h* is sandwiched by a flange face of the flange 1*g* and the wall 10*a* of the housing 10. When the axle of the agitation blade 1*a* moves in a direction of thrust, the sealing member 1*h* expands and contracts in the same direction. The length Z of the extension is set to be less than the axial thickness X of the sealing member 1*h*. Because of presence of the extension, when the sealing member 1*h* is pressed by the agitation blade 1*a* toward the wall 10*a*, the sealing member 1*h* is partially compressed, but not beyond the length Z of extension of the flange 1*g*. The sealing member 1*h* fulfils a sealing function upon being compressed in the direction of thrust. By setting dimensions as described above, over-compression of the sealing member 1*h* can be prevented. In addition, precision of the position of the agitation member 1*a* in the direction of thrust is improved.

As described above, a developer-storing container includes a developer-storing section including a developer agitation member that rotates to agitate developer, and a waste-developer-storing section including a waste-developer agitation member that rotates to agitate waste-developer, an axle of the developer agitation member and an axle of the waste-developer agitation member being coupled so as to form one axle, and the developer-storing section and the waste-developer-storing section being partitioned in such a way as to be adjacent to each other in a direction of the axle. In order to achieve the above object, a developer-storing container in connection with the above structure is characterized in that the developer-storing section and the waste-developer-storing section are formed by being partitioned by a fixed wall that is fixed to a housing of the developer-storing container in such a way that the developer-storing section and the waste-developer-storing section are adjacent to each other in the direction of the axle, and the developer agitation member and the waste-developer agitation member are constructably and deconstructably coupled to each other by a connecting member that is slidably, rotatably and detachably interdigitated to a bearing formed on the fixed wall.

In the above structure, assembly is carried out by interdigitating a connecting member to a fixed wall so that the developer agitation member and the waste-developer agitation member are coupled. Using the fixed wall makes it easy to assemble the developer-storing container. Further, using a fixed wall ensures that the connecting member is assembled at a precise position, and therefore the developer agitation member and the waste-developer agitation member are also assembled at precise positions.

Consequently, a developer-storing container that is easy to assemble and in which assembly dimensions of members are precise enough for the members to be closely interdigitated to each other is realized.

Further, in addition to the above structure, a developer-storing container of the example embodiment may be one in which: the waste-developer agitation member includes a cylindrical flange whose end section has an aperture, on an end section of the axle that is opposite to an end close to the fixed wall; an axle-supporting member that is interdigitated to an axle-hole formed on a wall of the housing of the developer-storing container, and is mounted in such a way as to extend to an inner part of the waste-developer-storing section, is inserted in the cylindrical flange; the axle-supporting member is fixed to the wall of the housing, and the cylindrical flange slides and rotates about the axle-supporting member; and an axial groove is formed on a part of the axle-supporting member that is to be inserted into the cylindrical flange so that the axle-supporting member is partially in contact with the inner face of the cylindrical flange.

In the above structure, the cylindrical flange of the waste-developer agitation member slides and rotates about the axle-supporting member. A space is created with the grooves between the inner face of the cylindrical flange and the axle-supporting member. The space can be made to act as a pool of toner. Therefore, even if toner migrates in between the cylindrical flange and the axle-supporting member, the toner can be led to the space, thereby preventing solidification of toner in a narrow gap.

Further, in addition to the above structure, a developer-storing container of the example embodiment may be one in which the waste-developer agitation member includes a flange on an end section of the axle that is on an end close to the fixed wall, the flange being in contact with an end section of the connecting member on a side close to the waste-developer agitation member.

In the above structure, the waste-developer agitation member can bear a thrust load against the fixed wall by contacting the flange with an end section of the connecting member.

Further, in addition to the above structure, a developer-storing container of the example embodiment may be one in which a space surrounded by the connecting member and the fixed wall is created.

In the above structure, the room surrounded by the connecting member and the fixed wall can be made to act as a pool of developer. Therefore, even if developer migrates to a gap between the fixed wall and the connecting member, the developer can be led to the space, thereby preventing solidification of developer in the gap.

Further, in addition to the above structure, a developer-storing container of the example embodiment may be one in which a space that is other than a space occupied by the axle and has an aperture on a side opposite to a side close to the fixed wall, is created on a side close to the developer-storing section of the connecting member or in an inner part on a side close to the waste-developer-storing section.

In the above structure, the space in the connecting member can be made to act as a pool of developer. Therefore, even if developer migrates to a gap between the connecting member and the axle in a condition in which the axle on the side of the developer-storing section or on the side of waste-developer-storing section is coupled to the connecting member, the developer can be led to the space, thereby preventing solidification of developer in the gap.

Further, in addition to the above structure, a developer-storing container of the example embodiment may be one in which the developer agitation member includes a crown-shaped flange having an extension on a side opposite to a side close to the fixed wall, on an end section of the axle that is opposite to an end close to the fixed wall, and a length of the extension is shorter than an axial thickness of a sealing member mounted in between the crown-shaped flange and a wall of the housing of the developer-storing container.

In the above structure, even if the developer agitation member presses the sealing member toward the wall of the housing of the developer-storing container, the sealing member would not be pressed beyond the length of extension of the crown-shaped flange, thereby preventing over-pressing of the sealing member. Further, precision of positioning of the developer agitation member in the direction of thrust is improved.

It will be clear that the example embodiments thus described may take many variations. Such variations are not to be regarded as a departure from the spirit and scope of the invention, as all such variations would be obvious to one skilled in the art, and are hence intended to be included within the scope of the following claims.

Further, a developer-storing container of the example embodiments may be preferably used in image forming apparatus employing an electrophotography method.

What is claimed is:

1. A developer-storing container comprising a developer-storing section including a developer agitation member that rotates to agitate developer, and a waste-developer-storing section including a waste-developer agitation member that rotates to agitate waste-developer, an axle of the developer agitation member and an axle of the waste-developer agitation member being coupled so as to form one axle; and the developer-storing section and the waste-developer-storing section being partitioned in such a way as to be adjacent to each other in a direction of the axle, wherein:

the developer-storing section and the waste-developer-storing section are formed by being partitioned by a fixed wall that is fixed to a housing of the developer-storing container in such a way that the developer-storing section and the waste-developer-storing section are adjacent to each other in the direction of the axle; and the developer agitation member and the waste-developer agitation member are capable of being disassembled from a connecting member that is slidably, rotatably and detachably interdigitated to a first bearing formed on the fixed wall.

2. A developer-storing container as set forth in claim 1, wherein:

the waste-developer agitation member includes a cylindrical flange whose end section has an aperture, on an end section of the axle that is opposite to an end close to the fixed wall;

an axle-supporting member that is interdigitated to an axle-hole formed on a wall of the housing of the developer-storing container, and is mounted in such a way as to extend to an inner part of the waste-developer-storing section, is inserted in the cylindrical flange;

the axle-supporting member is fixed to the wall of the housing, and the cylindrical flange slides and rotates about the axle-supporting member; and an axial groove is formed on a part of the axle-supporting member that is to be inserted into the cylindrical flange so that the axle-supporting member is partially in contact with the inner face of the cylindrical flange.

3. A developer-storing container as set forth in claim 1, wherein the waste-developer agitation member includes a flange on an end section of the axle that is on an end close to the fixed wall, the flange being in contact with an end section of the connecting member on a side close to the waste-developer agitation member.

4. A developer-storing container as set forth in claim 1, wherein the developer agitation member includes a crown-shaped flange having an extension extending in a direction away from the fixed wall, on an end section of the axle that is opposite to an end close to the fixed wall, and a length of the extension is shorter than an axial thickness of a sealing member mounted in between the crown-shaped flange and a wall of the housing of the developer-storing container.

5. A developer-storing container as set forth in claim 1, wherein the developer agitation member includes an agitation sheet that slides on an inner wall of the developer-storing section, and/or the waste-developer agitation member includes an agitation sheet that slides on an inner wall of the waste-developer-storing section.

6. The developer-storing container as set forth in claim 1, wherein:

a plurality of spaces, which become pools of developer, are formed by the waste-developer agitation member, the first bearing of the fixed wall and the connecting member.

7. The developer-storing container as set forth in claim 6, wherein the plurality of spaces includes:

a first space to which the developer leaked out from the developer-storing section is led; and a second space to which the developer in a gap between the connecting member and the axle of the waste-developer agitation member is led.

8. The developer-storing container of claim 7, wherein said first bearing has a circumference, and said first and second spaces are located within the circumference of said first bearing.

9. The developer-storing container as set forth in claim 1, wherein the fixed wall forms a part of the housing of the developer-storing section.

10. The developer-storing container of claim 1, further comprising a second bearing formed on the fixed wall, wherein said first and second bearings are arranged concentrically with respect to each other.

11. A connecting member which constitutes a developer-storing container, said developer-storing container comprising:

a developer-storing section including a developer agitation member that rotates to agitate developer; and a waste-developer-storing section including a waste-developer agitation member that rotates to agitate waste-developer, wherein an axle of the developer agitation member and an axle of the waste-developer agitation member are coupled so as to form one axle, and the developer-storing section and the waste-developer-storing section are formed so as to be partitioned by a fixed wall that is fixed to a housing of the developer-storing container in such a way that the developer-storing section and the waste-developer-storing section are adjacent to each other in a direction of the one axle, said connecting member, which is rotatably and detachably interdigitated to a bearing formed on the fixed wall, causing the developer agitation member and the waste-developer agitation member to be capable of being disassembled from the connecting member; and wherein an axle of said connecting member, the axle of the developer agitation member and the axle of the waste-developer agitation member are configured to rotate around a same center.

12. The connecting member as set forth in claim 11, wherein:

a plurality of spaces, which become pools of developer, are formed by the waste-developer agitation member, the bearing of the fixed wall and the connecting member.

13. The connecting member as set forth in claim 12, wherein the plurality of spaces includes:

a first space to which the developer leaked out from the developer-storing section is led; and a second space to which the developer in a gap between the connecting member and the axle of the waste-developer agitation member is led.

14. The connecting member as set forth in claim 11, wherein the fixed wall forms a part of the housing of the developer-storing section.

15. A developer-storing container comprising:

a fixed wall that is fixed to the developer-storing container and partitions a developer-storing section that includes a developer agitation member that rotates to agitate developer, and a waste-developer-storing section that includes a waste-developer agitation member that rotates to agitate waste-developer; and a connecting member that is slidably, rotatably, and detachably interdigitated to a bearing formed on the fixed wall, the developer agitation member and the waste-developer agitation member being capable of being disassembled from the connecting member, respectively, and an axle of the developer agitation member, an axle of a connecting section, and an axle of the waste-developer agitation member forming one axle.

16. The developer-storing container as set forth in claim 15, wherein:

a plurality of spaces, which become pools of developer, are formed by the waste-developer agitation member, the bearing of the fixed wall and the connecting member.

17. The developer-storing container as set forth in claim 16, wherein the plurality of spaces includes:

a first space to which the developer leaked out from the developer-storing section is led; and a second space to which the developer in a gap between the connecting member and the axle of the waste-developer agitation member is led.

18. The developer-storing container as set forth in claim 15, wherein the fixed wall forms a part of the housing of the developer-storing section.

* * * * *